US009243649B2

(12) United States Patent
Fournier et al.

(10) Patent No.: US 9,243,649 B2
(45) Date of Patent: Jan. 26, 2016

(54) ADJUSTABLE MECHANICAL COOLANT PUMP

(75) Inventors: Arnaud Fournier, Yutz (FR); Gilles Simon, Montois la Montagne (FR); Gabriel Mele, Nouilly (FR); Eric Majchrzak, Knutange (FR); Gilles Magnier, Ste. Marie Aux Chênes (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 786 days.

(21) Appl. No.: 13/582,459

(22) PCT Filed: Mar. 5, 2010

(86) PCT No.: PCT/EP2010/052796

§ 371 (c)(1),
(2), (4) Date: Oct. 18, 2012

(87) PCT Pub. No.: WO2011/107153

PCT Pub. Date: Sep. 9, 2011

(65) Prior Publication Data

US 2013/0034427 A1 Feb. 7, 2013

(51) Int. Cl.

| | |
|---|---|
| ***F04D 29/46*** | (2006.01) |
| ***F04D 15/00*** | (2006.01) |
| ***F04D 29/58*** | (2006.01) |
| ***F04D 29/62*** | (2006.01) |

(52) U.S. Cl.

CPC ..... *F04D 29/466* (2013.01); *F04D 15/0027* (2013.01); *F04D 29/586* (2013.01); *F04D 29/628* (2013.01)

(58) Field of Classification Search

CPC . F04D 29/426; F04D 29/466; F04D 15/0027; F04D 15/0254; F04D 29/586; F04D 29/605; F04D 29/628; F01P 7/06; F01P 2007/143; F02B 55/10; F01D 17/165

See application file for complete search history.

(56) References Cited

U.S. PATENT DOCUMENTS

| | | | | |
|---|---|---|---|---|
| 5,146,752 | A * | 9/1992 | Bruestle | 60/602 |
| 7,603,969 | B2 * | 10/2009 | Repple et al. | 123/41.1 |
| 8,235,653 | B2 * | 8/2012 | Genster | 415/148 |
| 8,240,984 | B2 * | 8/2012 | Noelle | 415/164 |

(Continued)

FOREIGN PATENT DOCUMENTS

| | | | |
|---|---|---|---|
| CN | 101253314 | A | 8/2008 |
| EP | 1 413 763 | A1 | 4/2004 |
| EP | 2 131 042 | A2 | 12/2009 |
| JP | 6-317298 | A | 11/1994 |

(Continued)

*Primary Examiner* — Richard Edgar
*Assistant Examiner* — Brian O Peters
(74) *Attorney, Agent, or Firm* — Norman B. Thot

(57) ABSTRACT

An adjustable mechanical coolant pump for an internal combustion engine includes a pump rotor wheel comprising an axial inlet. The pump rotor wheel is configured to pump a coolant radially outwardly. Variable pump stator blades are arranged so as to pivot radially outwardly at a circle concentrically with the pump rotor wheel. A control ring is configured to pivot the variable pump stator blades when the control ring is rotated. An actuator is configured to rotate the control ring so as to pivot the variable pump stator blades between an open position and a closed position. A pump housing body is configured to support the variable pump stator blades and the control ring. A separate static blade holding frame is mounted to the pump housing body. The variable pump stator blades and the control ring are captively mounted at the separate static blade holding frame.

4 Claims, 9 Drawing Sheets

(56) References Cited

U.S. PATENT DOCUMENTS

| | | | |
|---|---|---|---|
| 2004/0076513 | A1 | 4/2004 | Sishtla et al. |
| 2008/0216775 | A1 | 9/2008 | Repple et al. |
| 2009/0155058 | A1 | 6/2009 | Noelle |
| 2009/0301412 | A1 | 12/2009 | Genster |

FOREIGN PATENT DOCUMENTS

| | | | |
|---|---|---|---|
| JP | 2004-144087 | A | 5/2004 |
| JP | 2009-506256 | A | 2/2009 |
| WO | WO 2007/018529 | A1 | 2/2007 |
| WO | WO 2007/025375 | A2 | 3/2007 |

* cited by examiner

ADJUSTABLE MECHANICAL COOLANT PUMP

CROSS REFERENCE TO PRIOR APPLICATIONS

This application is a U.S. National Phase application under 35 U.S.C. §371 of International Application No. PCT/EP2010/052796, filed on Mar. 5, 2010. The International Application was published in English on Sep. 9, 2011 as WO 2011/107153 A1 under PCT Article 21(2).

FIELD

The present invention relates to an adjustable mechanical coolant pump for an internal combustion engine.

BACKGROUND

The coolant demand of a combustion engine depends on many factors, such as engine temperature, environment temperature, effective engine power etc. A mechanical coolant pump is directly driven by the internal combustion engine so that the rotational speed of the pump is strictly proportional to the rotation speed of the combustion engine. As a consequence, the mechanical coolant pump does not consider the coolant demand of the combustion engine.

More sophisticated mechanical coolant pumps are therefore made adjustable by different kinds of valve mechanisms. WO 2007/025375 A2 describes an adjustable mechanical coolant pump with pivotable pump stator blades surrounding the pump rotor wheel. The stator blades form an inlet valve so that the coolant flows through the open inlet valve before it is pumped by the pump rotor wheel radially inwardly. However, when the stator blades are in the closed position and the rotor wheel is rotating with high speed, cavitation can occur which causes undesirable effects.

The stator blades are pivotably mounted axially between two mounting rings and are pivoted by a separate control ring surrounding one mounting ring. During the assembly procedure, the control ring can fall off the mounting ring as long as the mounting rings and the control ring are not fixed to the pump housing body. When the control ring falls off, every single stator blade must be re-assembled with the control ring, which is a time consuming procedure.

SUMMARY

An aspect of the present invention is to provide an adjustable mechanical coolant pump with improved cavitation quality and with an improved assembly procedure.

In an embodiment, the present invention provides an adjustable mechanical coolant pump for an internal combustion engine which includes a pump rotor wheel comprising an axial inlet. The pump rotor wheel is configured to pump a coolant radially outwardly. Variable pump stator blades are arranged so as to pivot radially outwardly at a circle concentrically with the pump rotor wheel. A control ring is configured to pivot the variable pump stator blades when the control ring is rotated. An actuator is configured to rotate the control ring so as to pivot the variable pump stator blades between an open position and a closed position. A pump housing body is configured to support the variable pump stator blades and the control ring. A separate static blade holding frame is mounted to the pump housing body. The variable pump stator blades and the control ring are captively mounted at the separate static blade holding frame.

BRIEF DESCRIPTION OF THE DRAWINGS

The present invention is described in greater detail below on the basis of embodiments and of the drawings in which.

DETAILED DESCRIPTION

Figure 1:
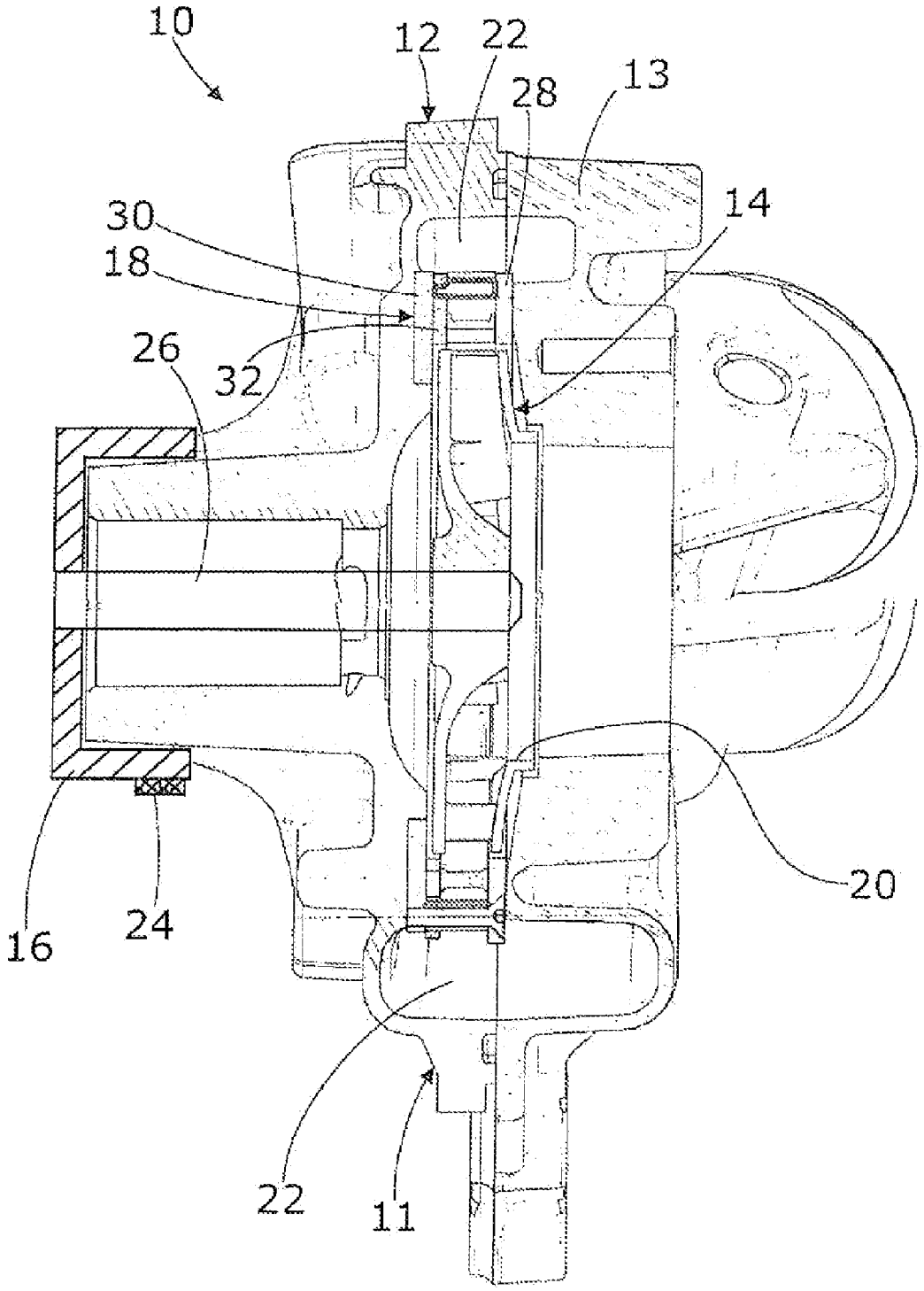
FIG. 1 shows a longitudinal cross section of an adjustable mechanical coolant pump.

The adjustable mechanical coolant pump is provided with a pump rotor wheel with an axial inlet and a radial outlet. The rotor wheel pumps the coolant radially outwardly, i.e., from the center radially to the outside. A set of variable pump stator blades is arranged at a circle, the circle being concentrically with and radially outwardly of the pump rotor wheel so that the pump stator blades form a ring-like outlet valve, not an inlet valve. This arrangement of the valve formed by the pump stator blades avoids cavitation when the stator blades are in a closed position, thereby minimizing the coolant flow even at high rotation speeds.

A separate static blade holding frame is provided to which all pump stator blades as well as the control ring are captively, i.e., unloosably, mounted. Before the blade holding frame is mounted to the pump housing body, the pump stator blades as well as the control ring are undetchably pre-assembled to the blade holding frame. Neither the pump stator blades nor the control ring can fall off the blade holding frame when the frame is mounted to the pump housing body. This facilitates the assembling of the coolant pump and reliably avoids any time-consuming re-assembling of the control ring and the stator blades.

In an embodiment of the present invention, the blade holding frame can, for example, comprise a first frame ring and a second frame ring. The control ring is mounted axially between the second frame ring and the blades. The stator blades and the control ring are sandwiched between the two frame rings. This constellation provides that the control ring is fixed to the blade holding frame and cannot fall off until the blade holding frame is mounted to the pump housing body.

In an embodiment of the present invention, the second frame ring can, for example, be provided with axial guiding projections cooperating with respective guiding openings of the control ring so that a rotation of the control ring is allowed and the control ring cannot move radially with respect to the second frame ring. It is self-evident that the guiding openings alternatively can be provided in the second frame ring and the projections at the control ring.

In an embodiment of the present invention, the two frame rings can, for example, be stiffly connected to each other by at least two, for example, by three, axial connection screws. The two frame rings and the connection screws together form the blade holding frame which is a cradle for the pump stator blades and the control ring.

In an embodiment of the present invention, the control ring can, for example, be provided with a long hole for every connection bolt projecting therethrough. The long holes have a circular coaxial orientation. The control ring is guided by the connection screws so that the control ring can rotate within a defined rotation angle. In an embodiment of the present invention, the control ring can, for example, be provided with fixation long holes. Each of the at least two axial connection screw can project through a respective fixation long hole.

In an embodiment of the present invention, the connection spacer sleeves can, for example, be provided with an axial bore. The connection screw projects through the axial bore of the sleeve which defines a constant axial distance of the two frame rings.

In an embodiment of the present invention, the pump stator blades can, for example, be provided with an axial pivot pin. The pivot pin lies in the pivot axis of the stator blades and is seated in respective pivot bores of the first frame ring.

In an embodiment of the present invention, the pump stator blades can, for example, be provided with an axial actuation pin projecting into respective actuation long holes of the control ring. The orientation of the actuation long holes is not coaxially circular so that a rotation of the control ring causes a synchronous pivot movement of all stator blades. By moving the control ring, the stator blades are moved into a closed or into the open position. In the closed position, the stator blades overlap each other at their tangential front and back ends to completely close the radial outlet of the pump rotor wheel.

Figure 2:
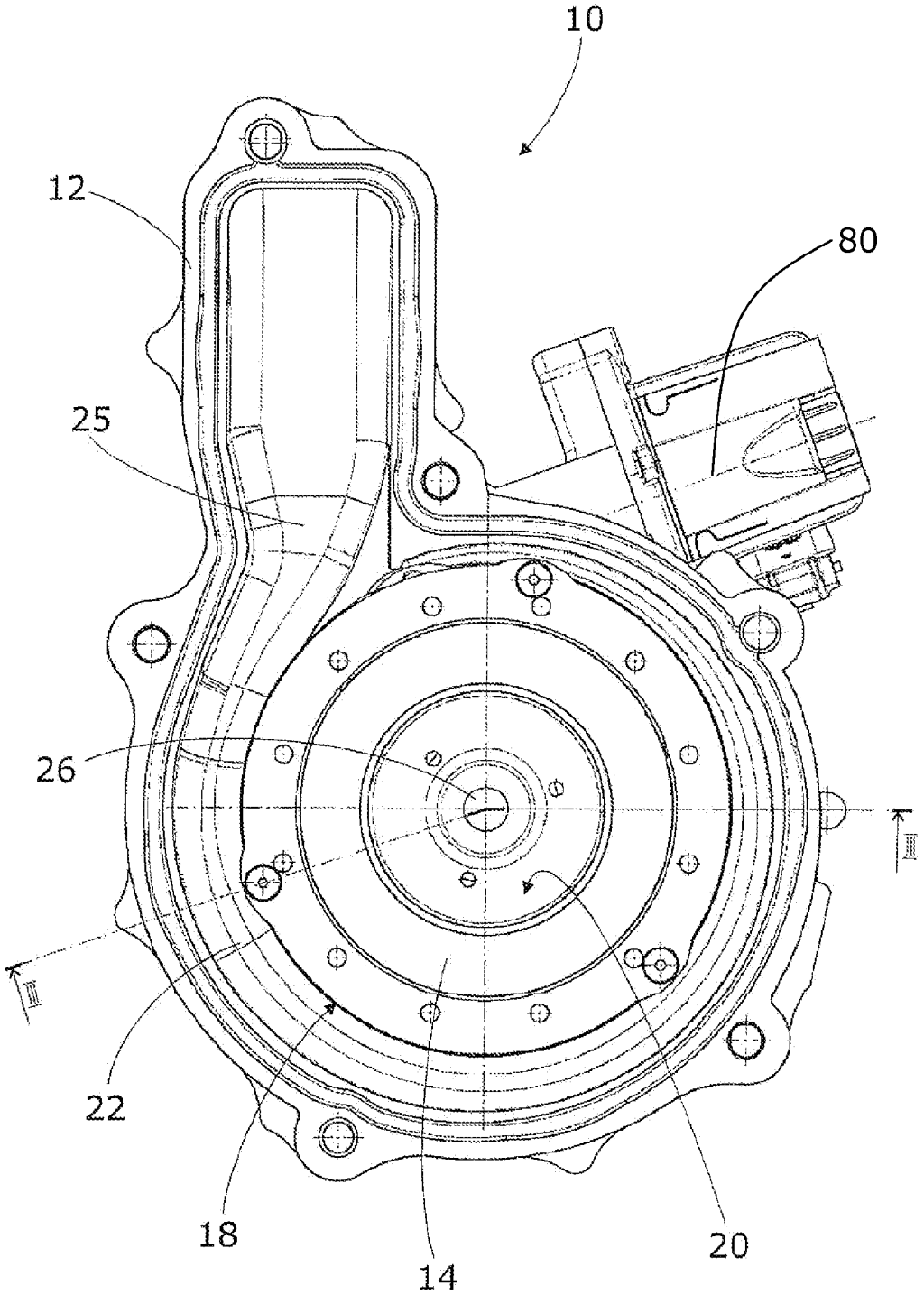
FIG. 2 shows a top view of the opened coolant pump of FIG. 1.
Figure 3:
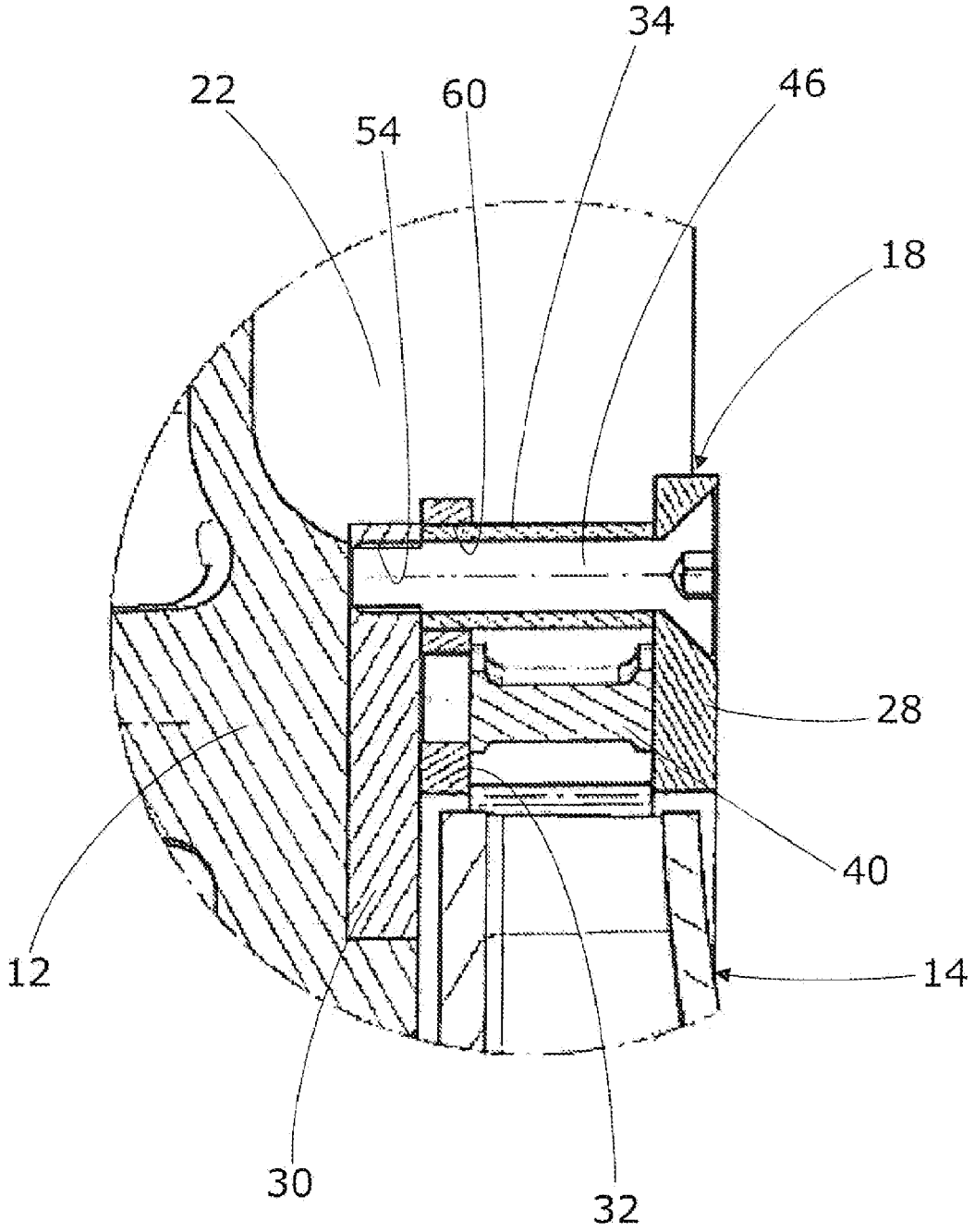
FIG. 3 shows a detail of the pump of FIG. 1 in cross section.

FIGS. 1 and 2 show an adjustable mechanical coolant pump 10 which is typically configured to provide coolant for a truck internal combustion engine.

The coolant pump 10 comprises a housing 11 which is composed of two metal pump housing bodies 12, 13. FIG. 2 shows a top view of the opened pump housing showing one pump housing body 12 wherein a separate blade holding frame 18 and a pump rotor wheel 14 are provided.

The pump rotor wheel 14 is provided with an axial inlet opening 20 constituting an axial inlet for the coolant flowing-in axially from an engine block (not shown). The pump rotor wheel 14 is connected to and co-rotating with a driving wheel 16, which is driven by a driving belt 24. The driving belt 24 is driven by the combustion engine so that the pump rotor wheel 14 rotates with a rotational speed which is proportional to the rotational speed of the combustion engine.

The pump rotor wheel 14 is radially surrounded by the static blade holding frame 18 which comprises a set of numerous variable pump stator blades 40 being arranged at a coaxial circle and being pivotable around axial pivot axis, respectively, between an open and a closed position. When the pump stator blades 40 are in their open position and the pump rotor 14 is rotating, the coolant is pumped by the pump rotor 14 radially outwardly into an outlet volute 22, and from the outlet volute 22 into an outlet channel 25. When the pump stator blades 40 are in the closed position, they form a closed ring around the pump wheel 14 so that the coolant cannot leave the rotating pump wheel 14.

Figure 4:
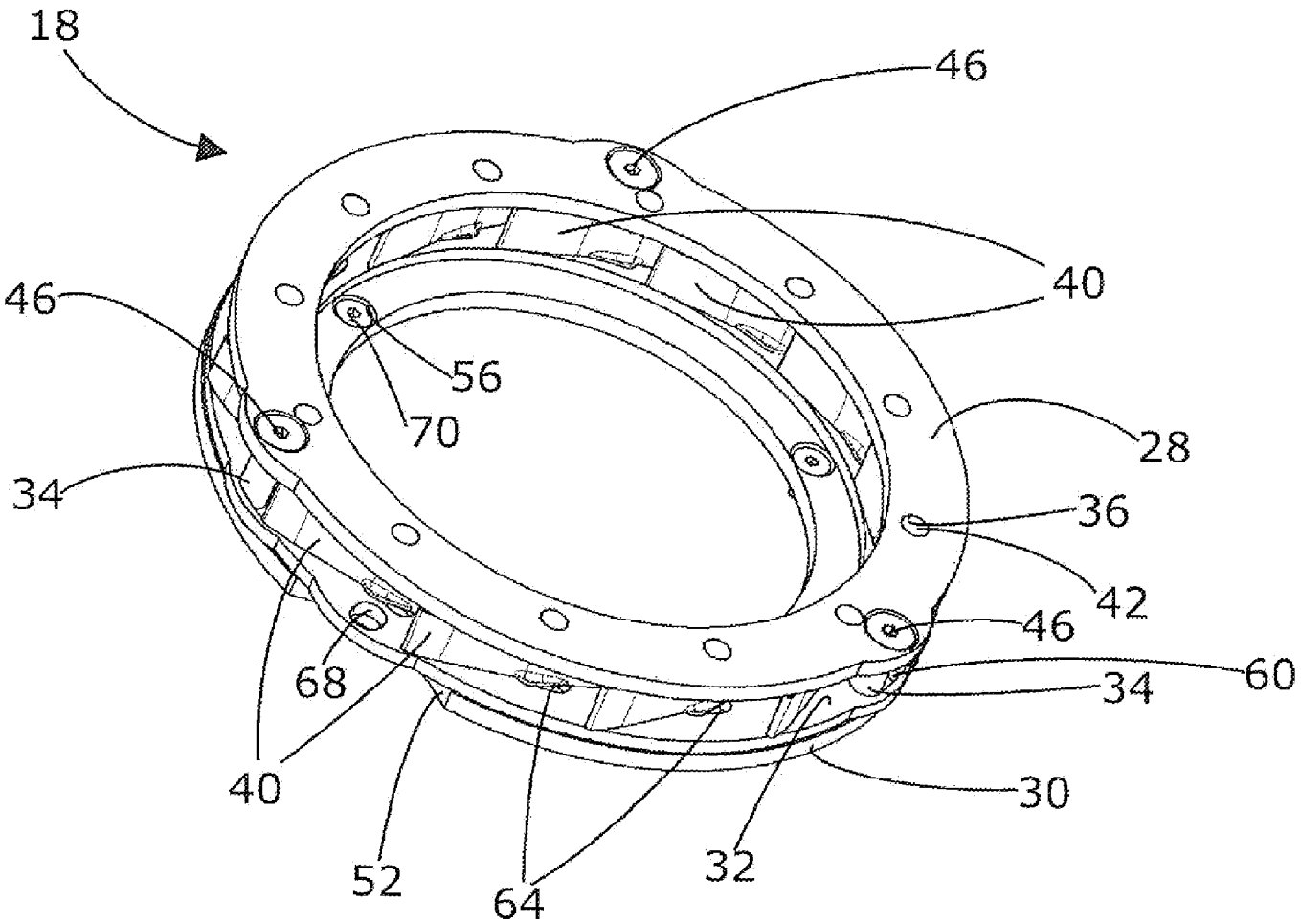
FIG. 4 shows perspective view of a blade holding frame of the coolant pump of FIG. 1.
Figure 5:
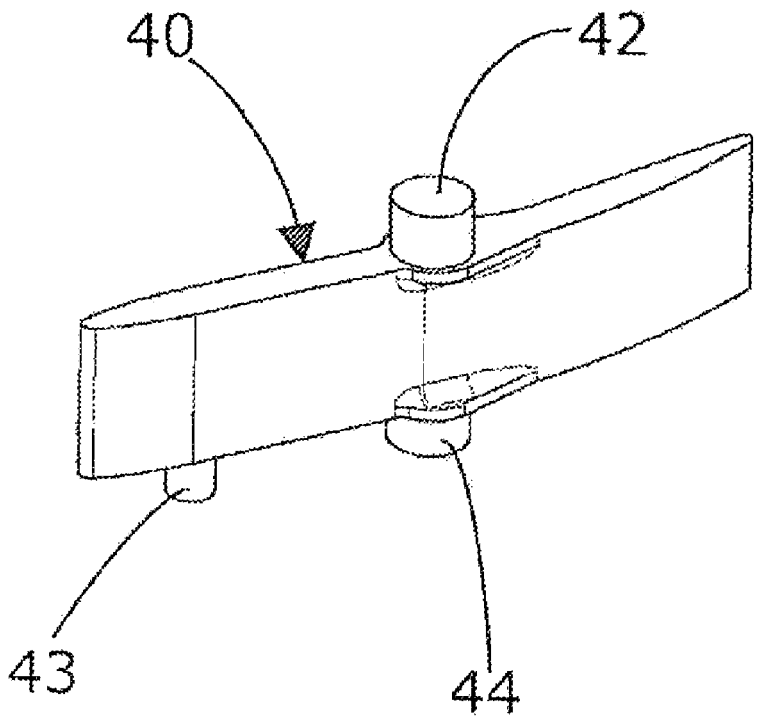
FIG. 5 shows a variable pump stator blade of the coolant pump of FIG. 1.
Figure 6:
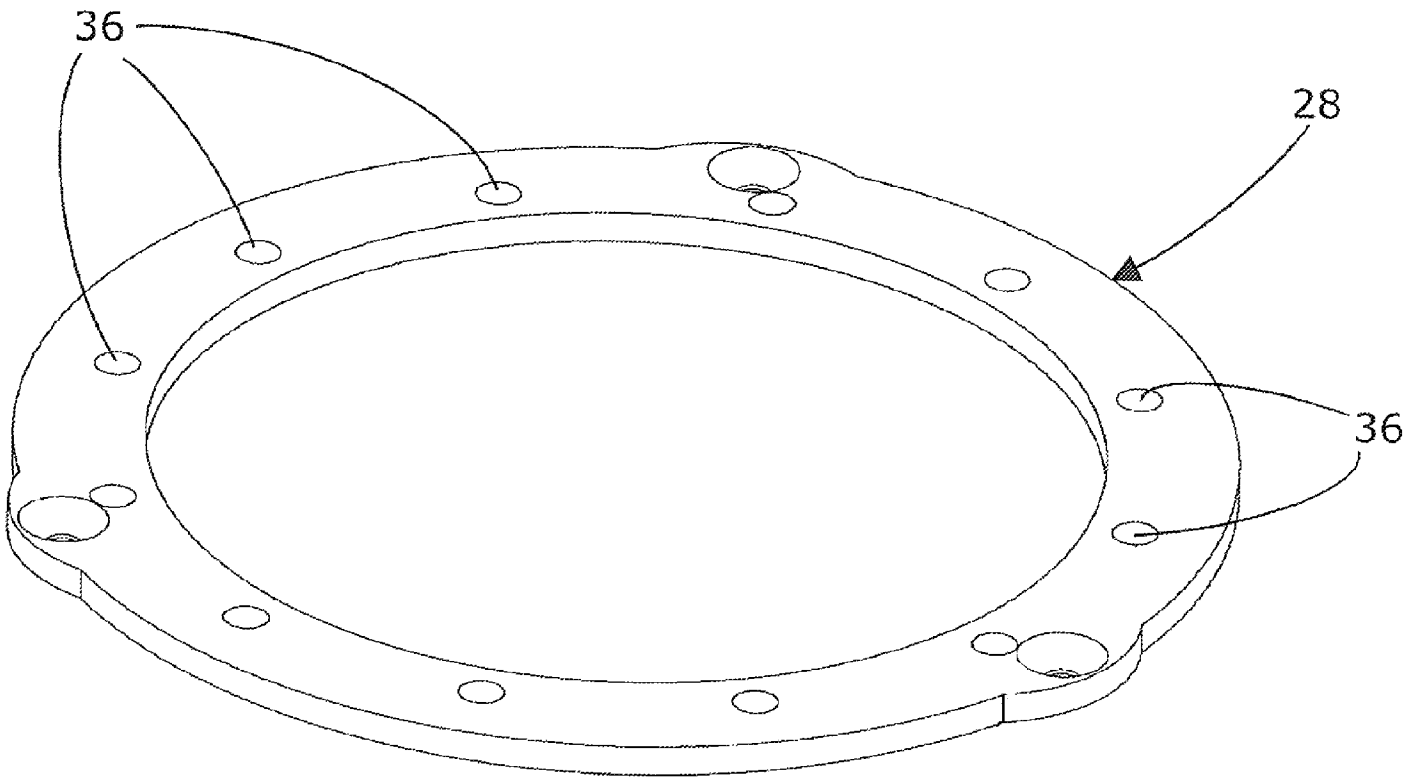
FIG. 6 shows a first frame ring of the blade holding frame of FIG. 4.
Figure 7:
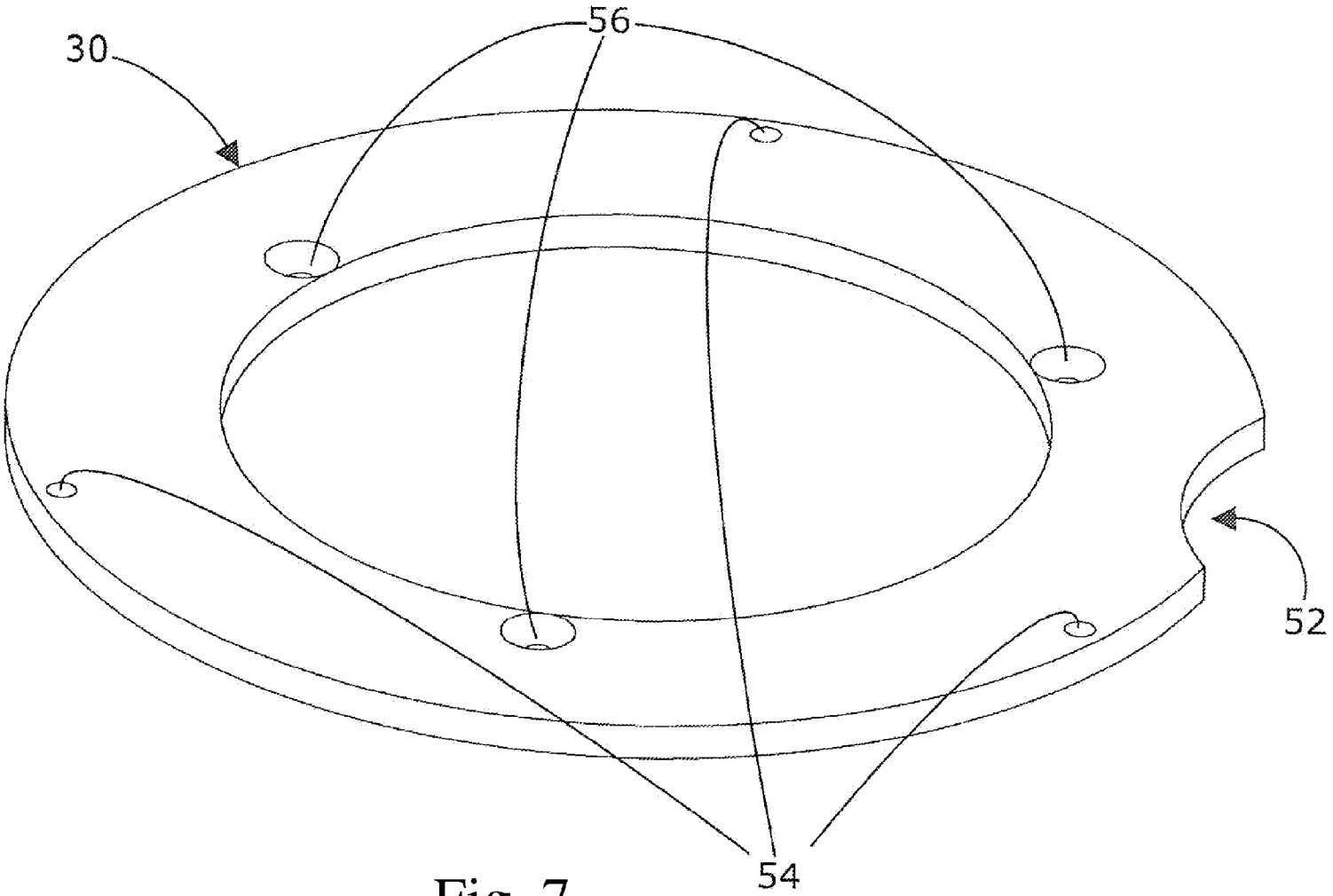
FIG. 7 shows a second frame ring of the blade holding frame of FIG. 4.
Figure 8:
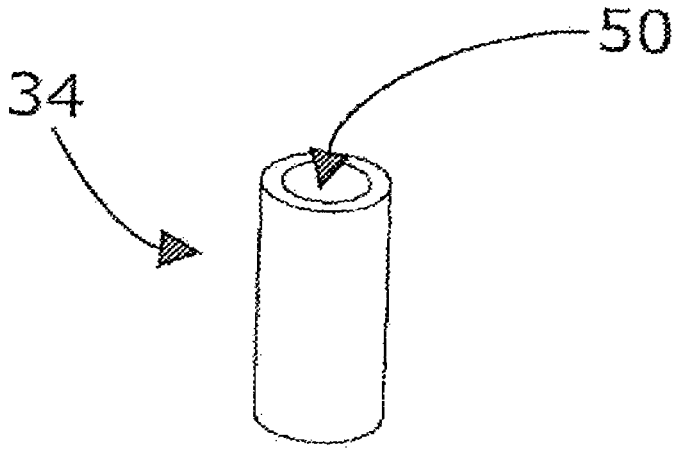
FIG. 8 shows an axial connection bolt of the blade holding frame of FIG. 4.
Figure 9:
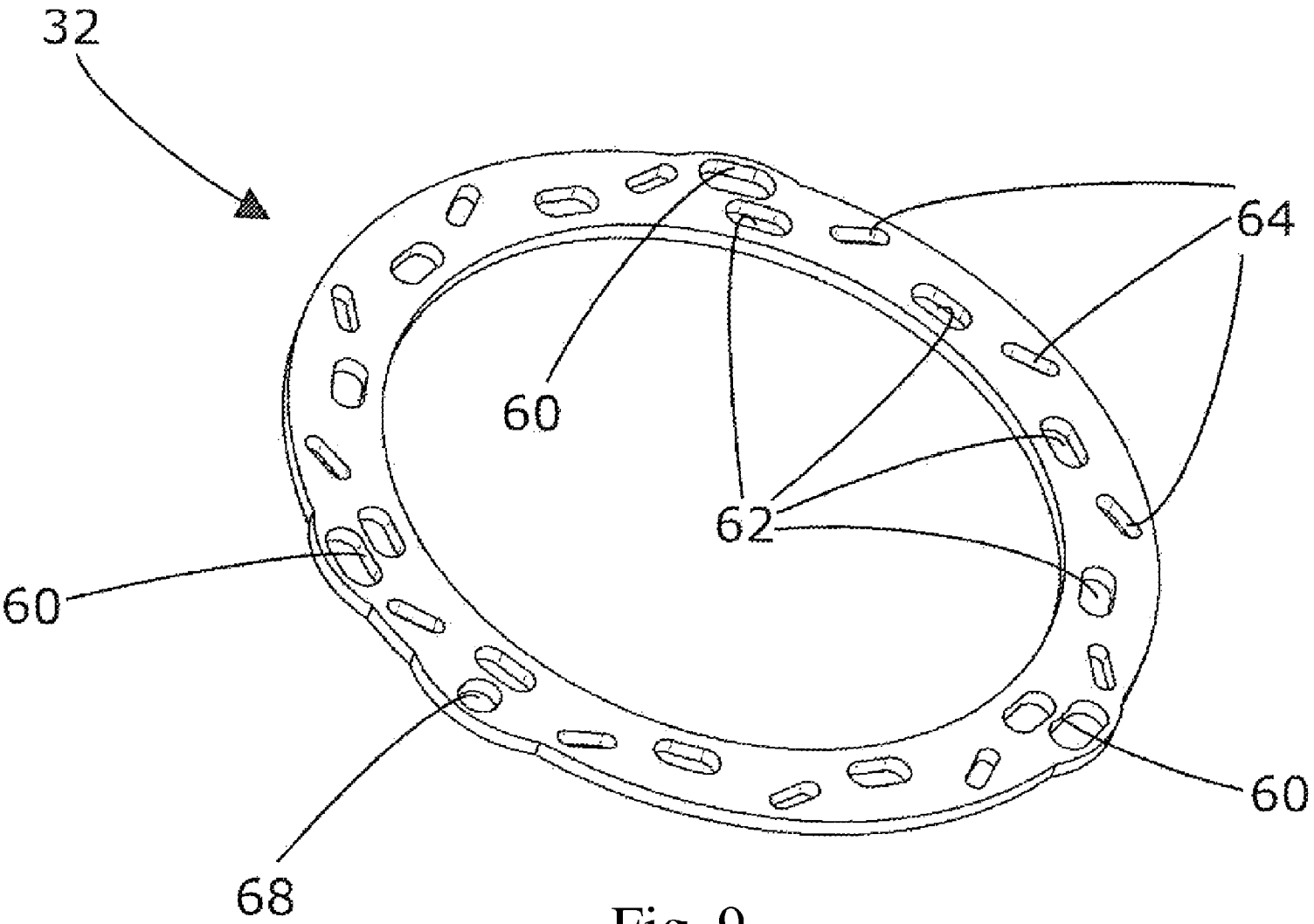
FIG. 9 shows a control ring of the blade holding frame of FIG. 4.

The blade holding frame 18 is shown in detail in FIG. 4. The blade holding frame 18 comprises a first frame ring 28, a second frame ring 30 being stiffly and unloosably connected in a constant axial distance to the first frame ring 28 by three axial connection screws 46 and spacer sleeves 34 with an axial screw bore 50. Numerous pump stator blades 40 are arranged axially adjacent to the first frame ring 28, and a control ring 32 is arranged axially between the pump stator blades 40 and the second frame ring 30.

Each pump stator blade 40 is provided with an axial pivot pin 42, an axial guiding pin 44 and an axial actuation pin 43. The pivot pin 42 and the guiding pin 44 are axially in-line and define the pivot axis of the pump stator blade 40. The pivot pins 42 of the blades 40 are seated in respective pivot bores 36 of the first frame ring 28. The axially opposite guiding pin 44 is seated in respective guiding long holes 62 of the control ring 32. The guiding long holes 62 and the guiding pins 44 support the stator blade 40 with respect to a radial forces. The guiding pins 44 can be seated in respective bores of the second frame ring 30.

Each actuation pin 43 of the stator blades 40 projects into and is guided by respective actuation long holes 64 of the control ring 32. The orientation of the actuation long holes 64 is not coaxially circular so that the pump stator blades 40 are pivoted between an open position and a closed position when the control ring 32 is rotated.

The control ring 32 is provided with an actuation bore 68 to which an actuator 80 is connected which is, for example, an electric actuation motor (not shown).

The second frame ring 30 has the same outer diameter as the first frame ring 28 but has a smaller inner diameter. The outer ring section of the second frame ring 30 is provided with three threaded holes 54 into which the connection screws are screwed. The inner ring section of the second frame ring 30 which projects to the inside is an assembling ring section with three assembling bores 56. The second frame ring 30 is provided with an actuator cut-out 52 in the moving range of the actuation bore 68 of the control ring 32.

The pump assembling procedure is as follows:

First, the static blade holding frame 18 and all the components, which are to be mounted to the frame 18, are assembled. The pivot pins 42 of the blades 40 are inserted into the respective pivot bores 36 of the first frame ring 28. The control ring 32 is then mounted and the guiding pins 44 and the actuation pins 43 of the blades 40 are inserted into the respective long holes 62, 64. Finally, the second frame ring 30 is attached to the control ring 32, and the first frame ring 28 and the second frame ring 30 are stiffly connected by the spacer sleeves 34 and the connection screws 46 both projecting through respective fixation long holes 60 in the control ring 32 to allow rotation of the control ring 32 with respect to the frame 18. The connection screws 46 are, for example, connected to the frame rings 28, 30 by screwing.

After the blade holding frame 18 is completely assembled, the blade holding frame 18 is fixed to the pump housing body 12 by three assembling screws 70 projecting through the respective assembling bores 56 of the second frame ring 30. The actuation mechanism (not shown) including the electric actuation motor is then mounted, and the actuation mechanism is connected with the actuation bore 68 of the control ring 32.

After that, the pump wheel 14 and the driving wheel 16 are mounted to the rotor shaft 26. Finally, the other pump housing body 13 is mounted to the first pump housing body 12 to close the pump housing 11, whereby the pump wheel 14 is inserted into the circular opening defined by the blade holding frame 18.

The present invention is not limited to embodiments described herein; reference should be had to the appended claims.

What is claimed is:

1. An adjustable mechanical coolant pump for an internal combustion engine, the adjustable mechanical coolant pump comprising:

a pump rotor wheel comprising an axial inlet, the pump rotor wheel being configured to pump a coolant radially outwardly;

variable pump stator blades arranged to pivot at a circle concentric with the pump rotor wheel;

a control ring configured to pivot the variable pump stator blades when the control ring is rotated, the control ring comprising fixation long holes;

an actuator configured to rotate the control ring so as to pivot the variable pump stator blades between an open position and a closed position;

a pump housing body configured to support the variable pump stator blades and the control ring, a separate static blade holding frame mounted to the pump housing body, the separate static blade holding frame comprising a first frame ring and a second frame ring, the control ring being mounted axially between the second frame ring and the variable pump stator blades; and at least two axial connection screws, wherein, the variable pump stator blades and the control ring are captively mounted at the separate static blade holding frame, the first frame ring and the second frame ring are stiffly connected to each other by the at least two axial connection screws, and each of the at least two axial connection screws is configured to project through a respective fixation long hole.

2. The adjustable mechanical coolant pump as recited in claim 1, further comprising spacer sleeves comprising an axial bore, wherein each of the at least two axial connection screws are respectively configured to project through a respective axial bore so that the first frame ring and the second frame are kept in a constant and fixed distance to each other.

3. The adjustable mechanical coolant pump as recited in claim 1, wherein each of the variable pump stator blades comprises an axial pivot pin, the first frame ring comprises pivot bores, and each axial pivot pin is configured to be seated in a respective pivot bore.

4. The adjustable mechanical coolant pump as recited in claim 3, wherein the variable pump stator blades further comprise an axial actuation pin, the control ring further comprises actuation long holes whose orientation is not coaxially circular, and each axial actuation pin is configured to project into a respective actuation long hole.

* * * * *